US006464460B2

(12) United States Patent
El-Nashar et al.

(10) Patent No.: US 6,464,460 B2
(45) Date of Patent: Oct. 15, 2002

(54) TURBINE BLADE WITH ACTIVELY COOLED SHROUD-BAND ELEMENT

(75) Inventors: Ibrahim El-Nashar, Kloten (CH); Beat Von Arx, Trimbach (CH); Bernhard Weigand, Filderstadt-Sielmingen (DE); Hartmut Haehnle, Küssaberg (DE); Rudolf Kellerer, Waldshut-Tiengen (DE)

(73) Assignee: Alstom (Switzerland) Ltd, Baden (CH)

( * ) Notice: Subject to any disclaimer, the term of this patent is extended or adjusted under 35 U.S.C. 154(b) by 15 days.

(21) Appl. No.: 09/725,722

(22) Filed: Nov. 30, 2000

(65) Prior Publication Data

US 2001/0006600 A1 Jul. 5, 2001

(30) Foreign Application Priority Data

Dec. 28, 1999 (DE) ..... 199 63 377

(51) Int. Cl.[7] ..... F01D 5/18

(52) U.S. Cl. ..... 416/92; 416/97 R; 416/191; 416/192

(58) Field of Search ..... 415/115; 416/97 R, 416/96 R, 96 A, 97 A, 191, 192, 92

(56) References Cited

U.S. PATENT DOCUMENTS

| | | | | | |
|---|---|---|---|---|---|
| 3,527,544 | A | | 9/1970 | Allen | 416/97 R |
| 5,197,852 | A | * | 3/1993 | Walker et al. | 415/115 |
| 5,306,401 | A | * | 4/1994 | Fierkens et al. | 415/115 |
| 5,460,486 | A | * | 10/1995 | Evans et al. | 416/97 R |
| 5,482,435 | A | | 1/1996 | Dorris et al. | 416/97 R |
| 5,785,496 | A | | 7/1998 | Tomita | 416/97 R |
| 6,152,695 | A | * | 11/2000 | Fukue et al. | 416/97 R |
| 6,254,345 | B1 | * | 7/2001 | Harris et al. | 416/96 R |
| 6,340,284 | B1 | * | 1/2002 | Beeck et al. | 415/115 |

FOREIGN PATENT DOCUMENTS

| | | | |
|---|---|---|---|
| GB | 1605335 | | 12/1991 |
| GB | 2290833 | A | 1/1996 |
| GB | 2298245 | A * | 8/1996 |
| JP | 58-47104 | A * | 3/1983 |

* cited by examiner

*Primary Examiner*—John G. Weiss
*Assistant Examiner*—Richard Woo
(74) *Attorney, Agent, or Firm*—Burns, Doane, Swecker & Mathis, L.L.P.

(57) ABSTRACT

In an air-cooled turbine blade (10) which has a shroud-band element (11) at the blade tip, the shroud-band element (11) extending transversely to the blade longitudinal axis, hollow spaces (16, 16', 17, 17') for cooling being provided in the interior of the shroud-band element (11), which hollow spaces (16, 16', 17, 17') are connected on the inlet side to at least one cooling-air passage (18) passing through the turbine blade (10) to the blade tip and open on the outlet side into the exterior space surrounding the turbine blade (10), the hollow spaces (16, 16', 17, 17') and the shroud-band element (11) are matched to one another in shape and dimensions in order to reduce the weight of the shroud-band element (11).

26 Claims, 3 Drawing Sheets

TURBINE BLADE WITH ACTIVELY COOLED SHROUD-BAND ELEMENT

FIELD OF THE INVENTION

The present invention relates to the field of gas turbine, more specifically it concerns an air-cooled turbine blades.

Air-cooled turbine blades have been disclosed, for example, in U.S. Pat. No. 5,482,435 and U.S. Pat. No. 5,785,496.

Modern gas turbine work at extremely high temperatures. This requires intensive cooling of the turbine blades which are used nowadays in modern gas turbines. In this case, it is usually especially difficult to effectively cool the exposed regions of the blades. One of these region is the shroud band or shroud-band element of the blade. one possibility of cooling the shroud-band element has been described in U.S. Pat. No. 5,785,496. In this publication, it is proposed (see FIGS. 1A and 1B there) to cool the shroud-band element by a number of parallel cooling holes which extend from the (central) moving blade through the shroud-band element to the outer edge of the shroud-band element and open there into the exterior space. In U.S. Pat. No. 5,482,435, only two holes running in opposite directions are provided for the same purpose.

However, these known solutions have disadvantages: the known cooling holes take up comparatively little space inside the shroud-band element. Since a certain minimum thickness of the shroud-band element is required for making the holes in the shroud-band element, and this thickness or an even greater thickness of the shroud-band element is also maintained in the region outside the holes, this results in an unfavorably small ratio of shroud-band volume through which flow occurs to shroud-band volume through which flow does not occur. The result of this is that the cooling of the shroud-band element is not optimal, and that the shroud-band element is comparatively heavy on account of the large proportion of solid material and is thus exposed to high mechanical loads during operation on account of the centrifugal forces.

To solve this problem, it has already been proposed (GB-A-2,290,833) to virtually completely dispense with cooling holes running in the interior of the shroud-band element and to instead cause cooling air to flow like film cooling out of a distribution passage via a number of small openings to the top side of the shroud-band element in order to permit a thinner and lighter shroud-band element. A problem in this case, however, is that the effectiveness of this surface film cooling of the shroud-band element greatly depends on the flow conditions prevailing on the top side of the shroud-band element and can therefore only be optimized with difficulty for the various operating states.

SUMMARY OF THE INVENTION

The object of the invention is therefore to provide a turbine blade having an air-cooled shroud-band element, in which turbine blade the abovementioned disadvantages can be avoided in a simple manner and which is characterized by effective cooling of the shroud-band element in particular with a marked reduction in the weight of the shroud-band element.

The essence of the invention is to design the hollow spaces carrying the cooling fluid in the interior of the shroud-band element so as to match the shroud-band element in shape and dimensions in such a way that the volume through which the cooling fluids flows takes up a high proportion of the total volume of the shroud-band element. In this way, the weight of the shroud-band element can be considerably reduced with at the same time very efficient cooling.

A first preferred embodiment of the turbine blade according to the invention is characterized by the fact that the hollow spaces comprise cooling holes, that the cooling holes are of tunnel-shaped design, the thickness of the shroud-band element being reduced outside the cooling holes, and that the cooling holes run from inside to outside essentially parallel to the direction of movement of the blade tip and in each case open upward into the exterior space upstream of the outer margin of the shroud-band element. The tunnel-shaped design of the cooling holes not only reduces the proportion of solid material at the shroud-band element but at the same time stiffens the shroud-band element mechanically. The cooling air discharging at the top can discharge without hindrance even when the shroud-band elements of all the blades of a turbine stage are lined up in sequence and combined to form an annular shroud band.

To this end, recesses are preferably made in the shroud-band element from the top side, and the cooling holes open laterally into the recesses. Furthermore, it is advantageous if a choke point for limiting the cooling-air mass flow is provided in each of the cooling holes, and the choke points are each arranged at the inlet side of the cooling holes. Some of the cooling holes may also be designed as diffusers.

A second preferred embodiment of the invention is characterized in that the hollow spaces are designed as slits which extend over the width of the shroud-band element, in that the slits run from inside to outside essentially parallel to the direction of movement of the blade tip and in each case open upward into the exterior space upstream of the outer margin of the shroud-band element, in that recesses are made in the shroud-band element from the top side, and in that the slits open laterally into the recesses. The wide slits result in good cooling with at the same time a considerable reduction in material. In this case, too, it may be advantageous to provide choke points for limiting the cooling-air mass flow in each of the slits, the choke points each being arranged at the inlet side and/or at the outlet side of the slits.

The cooling is especially effective if, in a preferred development of this embodiment, means of improving the heat transfer between cooling air and shroud-band element are provided in the slits. In particular, the slits may comprise a distributed arrangement of pins as a means of improving the heat transfer, the cooling fluid flowing around these pins in a turbulent manner, and the pins thus further improving the heat transfer between cooling fluid and shroud-band material.

A third preferred embodiment of the turbine blade according to the invention is characterized in that the hollow spaces comprise cooling holes extending in the direction of movement of the blade tip, in that a plurality of transverse holes cross the cooling holes, and in that the transverse holes are blocked off toward the exterior space by closed ends. This configuration of the crossing cooling holes is comparable in geometry to the abovementioned wide slits with distributed pin arrangement. Here, too, with greatly improved heat transfer, the solid material of the shroud-band element is considerably reduced and thus weight is saved. The crossing cooling holes are comparatively easy to make in the shroud-band element with conventional means. Cooling holes which are especially favorable from the cooling point of view can be obtained if the cooling holes and the transverse holes are produced by means of the so-called STEM drilling process.

The invention is described in the following detailed description with reference to the accompanying drawings, in which.

Figure 1:
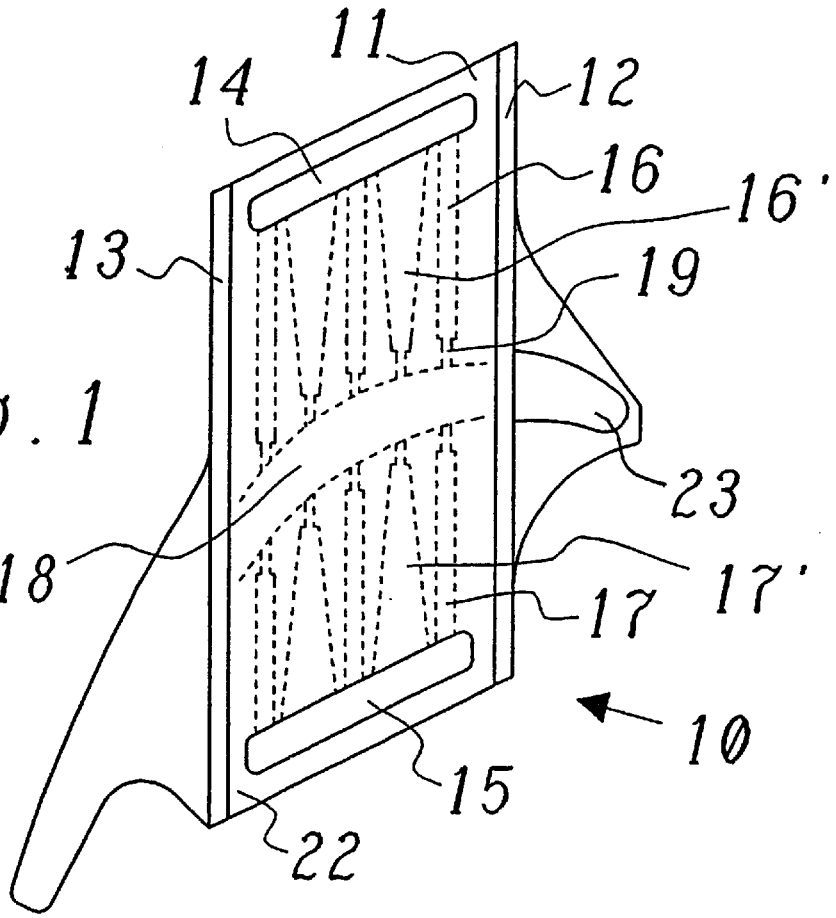
FIG. 1 shows a plan view of a first preferred embodiment of the turbine blade according to the invention with the tunnel-shaped cooling holes (indicated by broken lines) in the shroud-band element.

A first preferred embodiment of the turbine blade according to the invention is shown in plan view in FIG. 1. The turbine blade 10 comprises the actual blade profile 23 (extending perpendicularly to the drawing plane) and a shroud-band element 11, which is arranged transversely to the blade profile 23 on the blade tip and, together with the shroud-band elements of the other blades (not shown), results in a continuous, annular, mechanically stabilizing shroud band. The blade profile 23 is partly hollow in the interior, and passing through it are one or more cooling-air passages 18 (indicated by broken lines in FIG. 1), which direct cooling air from the blade root right up into the blade tip (see, for example, FIG. 2 of U.S. Pat. No. 5,482,435). On its top side (22 in FIG. 2), the shroud-band element 11 has two ribs 12 and 13, which run in parallel in the direction of movement of the blade tip and together with the opposite casing wall 20 of the gas turbine form a cavity 21 connected to the surroundings by gaps (FIG. 2).

In the interior of the shroud-band element 11, a plurality of cooling holes 16, 16' and 17, 17' (depicted by broken lines in FIGS. 1 and 2), starting from the center, run outward between and essentially parallel to the ribs 12, 13. The cooling holes may have the same form, but may also be of different configuration. In the exemplary embodiment in FIGS. 1 and 2, the cooling holes 16, 17 are designed as holes of largely constant diameter, whereas the cooling holes 16', 17' are designed as diffusers having a cross section widening in the direction of flow.

The cooling holes 16, 16' and 17, 17' are connected on the inlet side to the cooling-air passage 18 and are supplied with cooling air (or another cooling fluid) from the latter. As can be seen in FIG. 1, the cooling holes 16, 17 do not extend quite as far as the lateral end or margin of the shroud-band element 11, but in each case open from the side into an elongated recess 14 or 15, respectively, made in the shroud-band element 11 from the top side. This ensures that the cooling air always passes through the cooling holes even if two (adjacent) shroud-band elements are in mechanical contact. It goes without saying that, instead of the continuous recesses 14, 15, each of the cooling holes 16, 16' and 17, 17' may also be connected by itself to a separate recess. Furthermore, it is also conceivable to have the cooling holes 16, 16' and 17, 17' running at a slight angle and deviating from an orientation in parallel with one another if this is necessary in order to optimize the cooling over the entire area of the shroud-band element 11.

Figure 2:
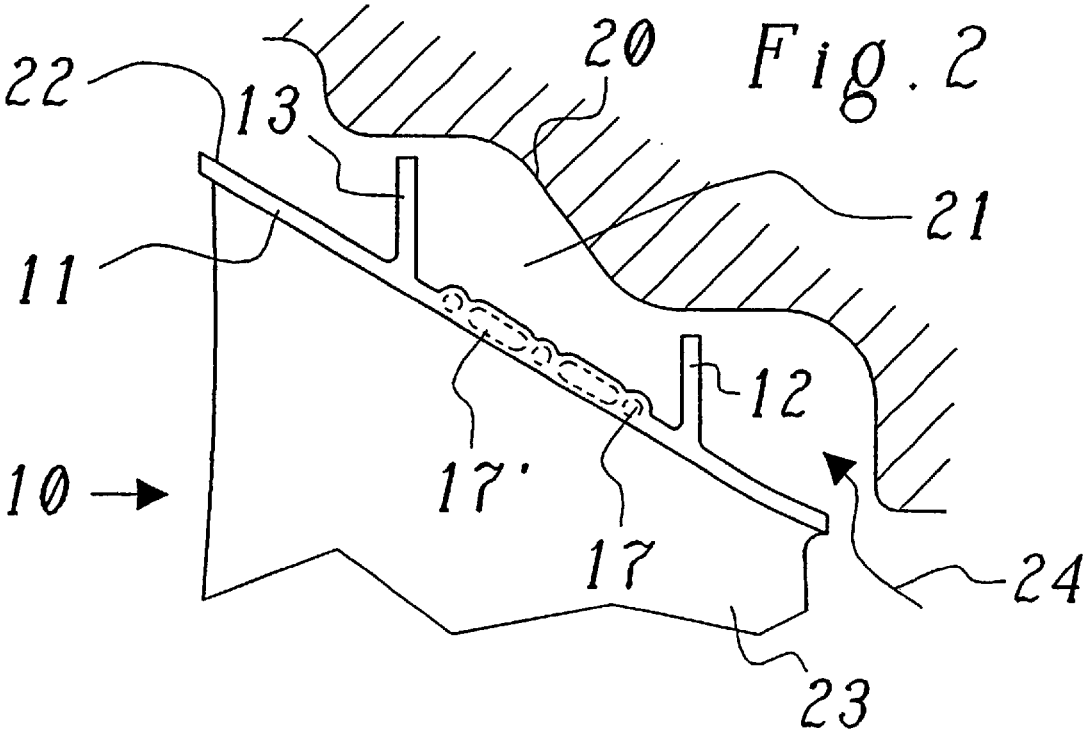
FIG. 2 shows the tip of the turbine blade according to FIG. 1 from the side, inside the gas turbine together with the opposite casing wall.

Furthermore, blowing of the cooling air toward the top leads to "inflation" of the cavity 21 in the shroud band (FIG. 2). This leads to an increase in the pressure in the gap between shroud-band element 11 and casing wall 20 and thus helps to reduce the penetrating mass flow of hot gas 24. Furthermore, the mixing temperature in this region is of course also reduced, as a result of which the thermal loading of the shroud-band element 11 from the top side 22 is reduced. Furthermore, it is advantageous to provide each of the cooling holes 16, 16' and 17, 17' with a choke point 19, preferably on the inlet side, i.e. in the region of the cooling-air supply at the profile 23. This makes it possible to specifically limit the cooling-air mass flow and obtain markedly more efficient cooling.

However, in the exemplary embodiment in FIGS. 1 and 2, a decisive factor for the reduction according to the invention in the weight of the shroud-band element 11 is that the cooling holes 16, 16' and 17, 17' are of tunnel-shaped design. This means that, as can clearly be seen in the side view of FIG. 2, the thickness of the shroud-band element 11 is reduced outside the cooling holes 16, 16'; 17, 17'. In this way, considerable material and thus weight can be saved in the shroud-band element. At the same time, the material volume to be cooled is reduced. Finally, the tunnel-shaped cooling holes 16, 16' and 17, 17' form rib-shaped prominences on the top side of the shroud-band element, and these rib-shaped prominences help to considerably increase the mechanical rigidity of the shroud-band element 11.

Figure 3:
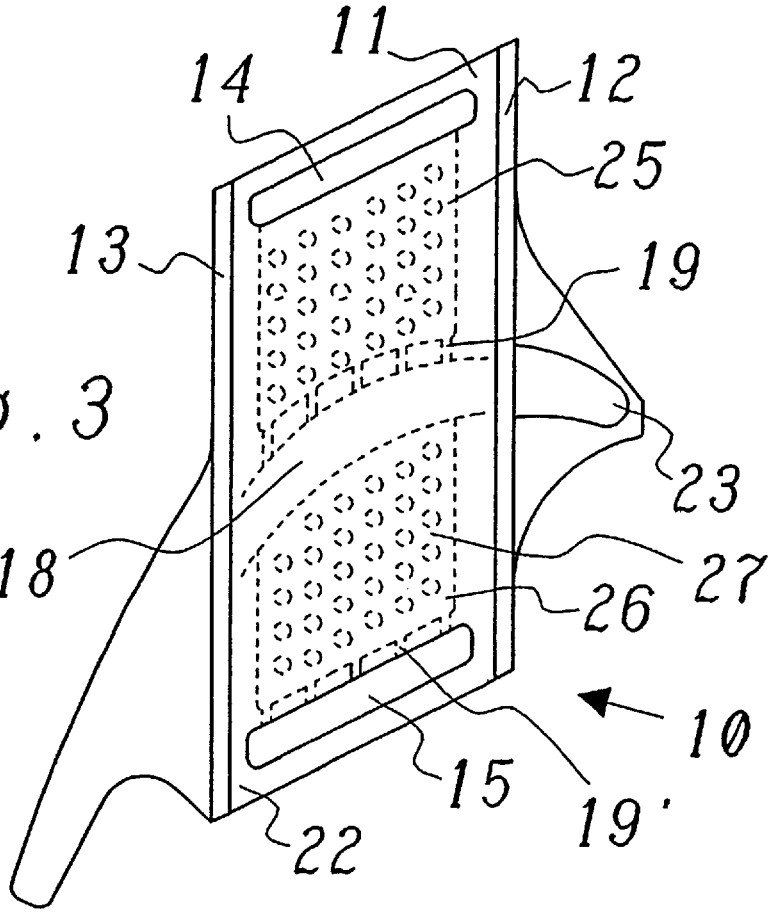
FIG. 3 shows a second preferred embodiment of the invention with wide slits and a regular arrangement of pins in the slits in a representation comparable with FIG. 1.
Figure 4:
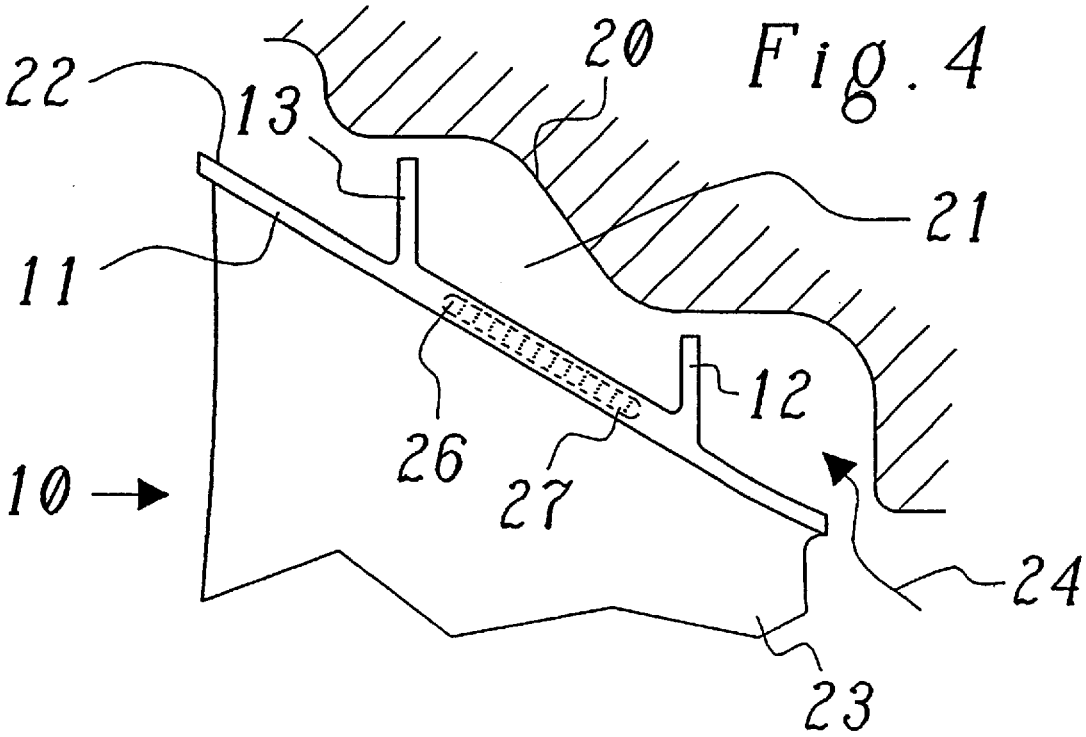
FIG. 4 shows the side view of the blade according to FIG. 3 in a representation comparable with FIG. 2.

An alternative form of the reduction in weight is reproduced in the exemplary embodiment in FIGS. 3 and 4. Here, instead of a multiplicity of cooling holes on either side of the blade profile, in each case a wide slit 25 or 26, respectively, is provided in the interior of the shroud-band element 11 and in each case extends from the central cooling-air passage 18 up to the lateral recesses 14 and 15, respectively, and opens there. On account of their continuous width, the slits 25, 26 lead to a considerable reduction in weight and ensure uniformly distributed cooling over the entire width. Here, too, choke points 19 and 19', respectively, for limiting the cooling-air mass flow may be provided in each case, the choke points in each case being positioned at the inlet side (choke points 19) and/or at the outlet side (choke points 19') of the slits 25, 26. The cooling effect by means of the slits 25, 26 can be further increased if a distributed arrangement (an array) of pins 27 is provided in the slits as a means of improving the heat transfer. The pins 27 increase the turbulence of the cooling-air flow and constitute additional areas for the heat transfer. In addition, they have a mechanically stabilizing effect if they extend from wall to wall in the slits. The number and arrangement of the pins in the array may be changed for the purposes of optimizing the cooling effect.

Figure 5:
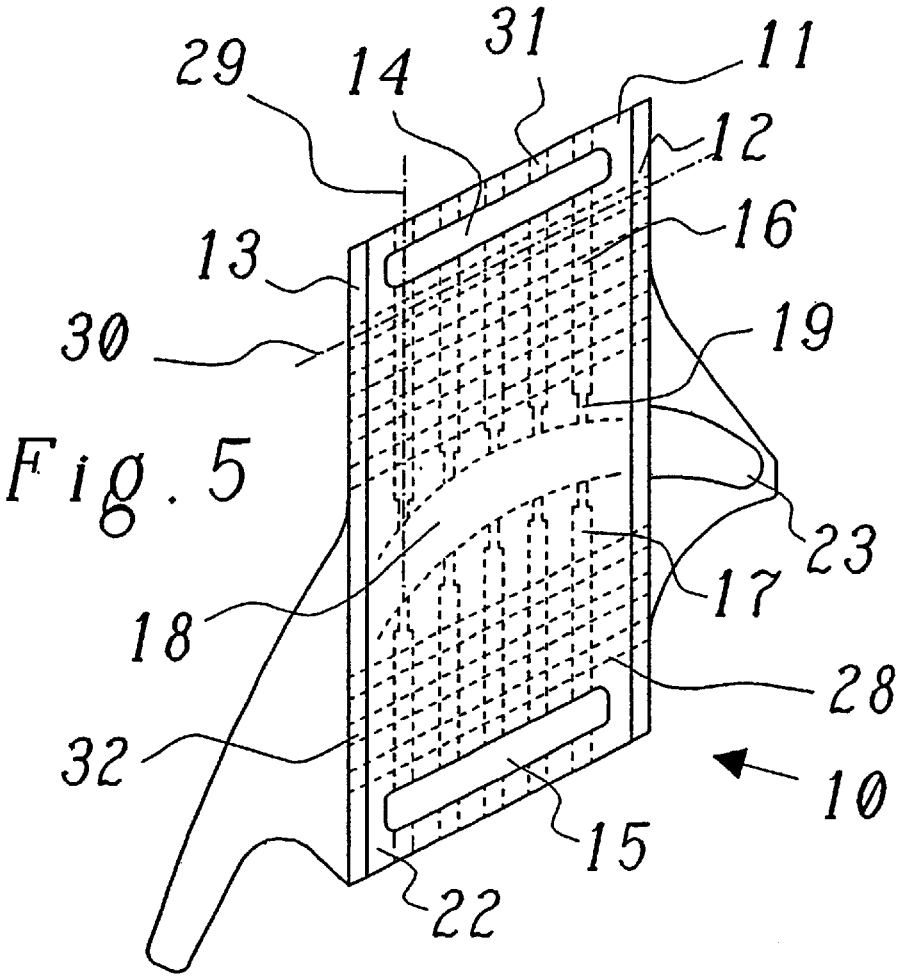
FIG. 5 shows a third preferred embodiment of the invention with crossing cooling holes and transverse holes in a representation comparable with FIG. 1.
Figure 6:
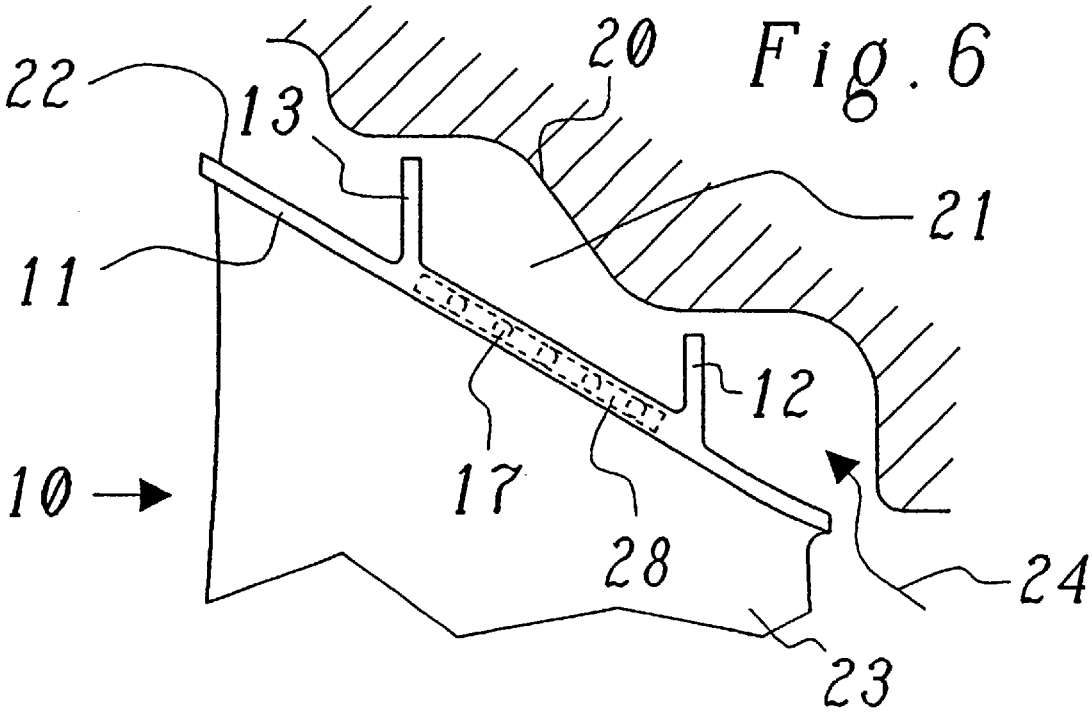
FIG. 6 shows the side view of the blade according to FIG. 5 in a representation comparable with FIG. 2.

A further alternative type of the reduction in weight within the scope of the invention is shown in FIGS. 5 and 6. Here, a matrix of parallel cooling holes 16, 17 (drilling axis 29) and transverse holes 28 (drilling axis 30) crossing the cooling holes 16, 17 is produced in the shroud-band element 11 and is comparable in its effect with regard to weight reduction and cooling with the slits, fitted with pins, of FIGS. 3 and 4. The cooling holes 16, 17 and the transverse holes 28—as well as the cooling holes in FIGS. 1 and 2—are preferably produced with the so-called STEM drilling process, which is described in full detail in U.S. Pat. No. 5,306,401. As a result, it is possible (by changing the feed) to provide the cooling holes 16, 17 and transverse holes 28 with internal roughness features, such as, for example, turbulence features or ribs. This leads to markedly more efficient cooling, since the shape of the cooling hole can be optimized. The cooling hole 16, 17 and transverse holes 28 are blocked off toward the side by ends 31 and 32 respectively, which are closed after the drilling. Here, too, the cooling holes 16, 17 preferably have choke points 19 and open into laterally arranged recesses 14, 15 open at the top.

What is claimed is:

1. An air-cooled turbine blade, comprising:

a shroud-band element at a tip of the blade, the shroud-band element extending transversely to the blade longitudinal axis, hollow spaces for the cooling being provided in the interior of the shroud-band element, said hollow spaces comprising cooling holes that are tunnel-shaped and being connected on an inlet side to at least one cooling-air passage passing through the turbine blade to the blade tip and open on an outlet side into an exterior space surrounding the turbine blade wherein a portion of the shroud-band element defining the hollow spaces conforms to the hollow spaces in shape and dimensions such that the wall thickness of the portion of the shroud-band element around the hollow spaces is reduced and is substantially the same along at least a portion of the outer periphery of said tunnel-shaped cooling holes in order to reduce the weight of the shroud-band element.

2. The turbine blade as claimed in claim 1, wherein the cooling holes open toward the top side of the shroud-band element into the exterior space.

3. The turbine blade as claimed in claim 1, wherein the cooling holes run from inside to outside essentially parallel to the direction of movement of the blade tip and in each case open upward into the exterior space upstream of the outer margin of the shroud-band element.

4. The turbine blade as claimed in claim 1, wherein recesses are made in the shroud-band element from the top side, and in the cooling holes open laterally into the recess.

5. The turbine blade as claimed in claim 1, wherein a choke point for limiting the cooling-air mass flow is provided in each of the cooling holes, and in that the choke points are each arranged at the inlet side of the cooling holes.

6. The turbine blade as claimed in claim 1, wherein at least some of the cooling holes are designed as diffusers.

7. The turbine blade as claimed in claim 1, wherein ribs which run parallel to one another and are at the distance apart are provided on the top side of the shroud-band element, and these ribs together with the opposite casing wall of the gas turbine form a cavity, and in that the hollow spaces open into the cavity.

8. An air-cooled turbine blade, comprising:

a shroud-band element at a tip of the blade, the shroud-band element extending transversely to the blade longitudinal axis, hollow spaces for cooling being provided in the interior of the shroud-band element, said hollow spaces being designed as slits which extend over the width of the shroud-band element and being connected on an inlet side to at least one cooling-air passage passing through the turbine blade tip and open on an outlet side into an exterior space surrounding the turbine blade wherein a portion of the shroud-band element defining the hollow spaces conforms to the hollow spaces in shape and dimensions in order to reduce the weight of the shroud-band element.

9. The turbine blade as claimed in claim 8, wherein the slits open toward the top side of the shroud-band element into the exterior space.

10. The turbine blade as claimed in claim 9, wherein the slits run from inside to outside essentially parallel to the direction of movement of the blade tip and in each case open upward into the exterior space upstream of the outer margin of the shroud-band element.

11. The turbine blade as claimed in claim 9, wherein recesses are made in the shroud-band element from the top side, and in that slits open laterally into the recesses.

12. The turbine blade as claimed in claim 8, wherein choke points for limiting the cooling-air mass flow are provided in each of the slits and in that the choke points are each arranged at the inlet side and/or at the outlet side of the slits.

13. The turbine blade as claimed in claim 8, wherein means of improving the heat transfer between cooling air and shroud-band element are provided in the slits.

14. The turbine blade as claimed in claim 13, wherein the slits comprise a distributed arrangement of pins as a means of improving the heat transfer.

15. An air-cooled turbine, comprising:

a shroud-band element at a tip of the blade, the shroud-band element extending transversely to the blade longitudinal axis, hollow spaces for cooling being provided in the interior of the shroud-band element, said hollow spaces comprising cooling holes extending in the direction of movement of the blade tip, and a plurality of transverse holes crossing the cooling holes to form a matrix of holes, said cooling holes being connected on an inlet side to at least one cooling-air passage passing through the turbine blade to the blade tip and open on an outlet side into an exterior space surrounding the turbine wherein a portion of the shroud-band element defining the hollow spaces conforms to the hollow spaces in shape and dimensions such that the weight of the shroud-band element is reduced.

16. The turbine blade as claimed in claim 15, wherein the transverse holes are blocked off toward the exterior space by closed ends.

17. The turbine blade as claimed in claim 15, wherein the cooling holes in each case open upward into the exterior space upstream of the outer margin of the shroud-band element.

18. The turbine blade as claimed in claim 15, wherein recesses are made in the shroud-band element from the top side, and in that the cooling holes open laterally into the recesses.

19. The turbine blade as claimed in claim 15, wherein a choke point for limiting the cooling-air mass flow is provided in each of the cooling holes, and in that the choke points are each arranged at the inlet side of the cooling holes.

20. The turbine blade as claimed in claim 15, wherein the cooling holes and the transverse holes are produced by means of the STEM drilling process.

21. An air cooled turbine blade assembly including a blade root and a blade tip and a shroud-band element secured on the blade tip, the assembly comprising:

cooling air passages extending through the turbine blade from the blade root to the blade tip, the shroud-band element having a bottom side and a top side, the bottom side being secured on the blade tip, the shroud-band element having cooling holes between the bottom side and the top side, the cooling holes in the shroud-band element having inlets connected to the cooling air passages extending in the direction away from the intersection between the blade tip and the shroud-band element, a pair of ribs projecting outwardly from the top side of the shroud-band element and the cooling holes being located in the portion of the shroud-band element between the ribs, with the portion of the shroud-band element between the ribs conforming in contour to the outer periphery of the cooling holes such that the wall thickness of the shroud-band element between the ribs is substantially less than the thickness of the shroud-band element outside the ribs.

22. The turbine blade assembly according to claim 21, wherein the cooling holes through the shroud-band element open into at least one recess to direct cooling air into the at least one recess, with the at least one recess opening to the top side of the shroud-band element.

23. The turbine blade assembly according to claim 21, wherein at at least one of the cooling holes in the shroud-band element is in the shape of a diffuser.

24. The turbine blade assembly according to claim 21, wherein the cooling holes in the shroud-band element extend away from the blade on opposite sides of the intersection between the blade and the shroud-band element.

25. The turbine blade assembly according to claim 21, wherein the cooling holes in the shroud-band element include choke points for limiting the mass flow.

26. The turbine blade assembly according to claim 21, wherein the cooling holes are designed as slits extending over the width of the portion of the shroud-band element between the ribs, and transverse pins are provided in the slits extending from the bottom side of the slits to the top side of the slits.

* * * * *